US007484518B2

(12) United States Patent
Brader

(10) Patent No.: US 7,484,518 B2
(45) Date of Patent: Feb. 3, 2009

(54) REVERSIBLE UMBRELLA

(76) Inventor: Noah Brader, 735 Ceramic Pl., Suite 220, Westerville, OH (US) 43081

( * ) Notice: Subject to any disclaimer, the term of this patent is extended or adjusted under 35 U.S.C. 154(b) by 17 days.

(21) Appl. No.: 11/625,523

(22) Filed: Jan. 22, 2007

(65) Prior Publication Data

US 2007/0169801 A1 Jul. 26, 2007

Related U.S. Application Data

(60) Provisional application No. 60/761,278, filed on Jan. 23, 2006, provisional application No. 60/826,436, filed on Sep. 21, 2006.

(51) Int. Cl.
*A45B 19/00* (2006.01)
*A45B 25/14* (2006.01)

(52) U.S. Cl. ..... 135/31; 135/25.33; 135/28

(58) Field of Classification Search ..... 135/16, 135/15.1, 20.3, 25.1, 28–31, 33.4, 33.7, 25.33
See application file for complete search history.

(56) References Cited

U.S. PATENT DOCUMENTS

| | | | | | |
|---|---|---|---|---|---|
| 973,207 | A | * | 10/1910 | Olark | 135/31 |
| 973,406 | A | * | 10/1910 | Pokorny | 135/25.4 |
| 1,161,139 | A | | 11/1915 | Larsson | |
| 1,474,821 | A | | 1/1923 | Hartzell | |
| 2,788,792 | A | * | 4/1957 | Koller | 135/15.1 |
| 3,779,260 | A | * | 12/1973 | Garay | 135/25.33 |
| 4,007,753 | A | | 2/1977 | DeMarco | |
| 4,326,301 | A | | 4/1982 | Brock | |
| 4,674,524 | A | | 6/1987 | DeMarco | |
| 4,711,260 | A | * | 12/1987 | Wiens et al. | 135/16 |
| 5,247,956 | A | * | 9/1993 | Vincent | 135/29 |
| 5,615,697 | A | | 4/1997 | Lin et al. | |
| 5,865,200 | A | | 2/1999 | Kuang et al. | |
| 5,909,746 | A | | 6/1999 | Doster et al. | |
| 6,520,193 | B2 | * | 2/2003 | You | 135/33.7 |
| 6,805,144 | B2 | * | 10/2004 | Usui et al. | 135/34.2 |
| 2004/0211451 | A1 | * | 10/2004 | Goh | 135/31 |
| 2008/0006313 | A1 | * | 1/2008 | Wang | 135/31 |

FOREIGN PATENT DOCUMENTS

| | | | |
|---|---|---|---|
| EP | 0049226 | | 9/1981 |
| JP | 04279105 | A * | 10/1992 |

* cited by examiner

*Primary Examiner*—Winnie Yip

(57) ABSTRACT

A reversible umbrella is provided. This device includes a supportive pole having an upper portion and a lower portion and a canopy assembly slidably mounted thereon. The canopy assembly further includes first, second, and third sliding collars mounted on the supportive pole; a canopy attached to a plurality of canopy support rods, wherein each of the plurality of canopy support rods is hingeably attached at one end to the third sliding collar; a first plurality of connector rods, wherein one end of each connector rod is hingeably attached to one of the canopy support rods and wherein the other end of the connector rod is hingeably attached to the second sliding collar; and a second plurality of connector rods, wherein one end of each connector rod is hingeably attached to one of the first plurality of connector rods and wherein the other end is hingeably attached to the first sliding collar.

14 Claims, 4 Drawing Sheets

REVERSIBLE UMBRELLA

CROSS-REFERENCES TO RELATED APPLICATIONS

This patent application claims the benefit of U.S. Provisional Patent Application Ser. No. 60/761,278, filed on Jan. 23, 2006 and entitled "Inwardly Folding Umbrella" and U.S. Provisional Patent Application Ser. No. 60/826,436, filed on Sep. 21, 2006 and entitled "Inwardly Folding Umbrella", the disclosures of which are incorporated by reference as if fully written herein.

BACKGROUND OF THE INVENTION

The present invention relates generally to umbrellas, and more specifically to an inwardly folding umbrella that includes mechanical means for reversing the directional folding pattern common to most commercially available umbrellas.

Umbrellas are common, commercially available items used by many people to protect themselves from rain, and in some cases from the sun. Although basically effective for their intended purpose, umbrellas are not entirely problem-free devices. For example, when a user of an umbrella enters an automobile, the user must close the umbrella as he or she sits down on one of the seats in the car. Upon closing the umbrella, water that has accumulated on the canopy is, unfortunately and undesirably, often directed off the canopy and onto the user. Because getting wet in this manner is contrary to the purpose for using the umbrella in the first place, there is an ongoing need for an umbrella that may be closed in a manner that directs water away from, rather than toward, the user thereof.

SUMMARY OF THE INVENTION

The following provides a summary of exemplary embodiments of a reversible and inwardly folding umbrella according to the present invention. This summary is not an extensive overview and is not intended to identify key or critical aspects or elements of the present invention or to delineate its scope.

In accordance with one aspect of the present invention, a reversible umbrella is provided. An exemplary embodiment of this device includes: a supportive pole having an upper portion and a lower portion; and a canopy assembly slidably mounted on the supportive pole. The canopy assembly further includes first, second, and third sliding collars mounted on the supportive pole, wherein the first sliding collar is located on the lower portion of the pole, wherein the third sliding collar is located on the upper portion of the pole, and wherein the second sliding collar is located between the first and third sliding collars; a canopy attached to a plurality of canopy support rods, wherein each of the plurality of canopy support rods is hingeably attached at one end to the third sliding collar; a first plurality of connector rods, wherein one end of each connector rod is hingeably attached to one of the canopy support rods and wherein the other end of the connector rod is hingeably attached to the second sliding collar; and a second plurality of connector rods, wherein one end of each connector rod is hingeably attached to one of the first plurality of connector rods and wherein the other end is hingeably attached to the first sliding collar.

In accordance with another aspect of the present invention, an inwardly folding umbrella is provided. An exemplary embodiment of this device includes: a supportive pole and a canopy assembly slidably mounted on the supportive pole.

The supportive pole further comprises: a cap mounted on one end thereof; a handle mounted on the opposite end thereof; and first, second, and third locking members mounted partially within the supportive pole, wherein the first locking member is located near the handle, wherein the third locking member is located near the cap, and wherein the second locking member is located between the first and third locking members. The canopy assembly further comprises: first, second, and third sliding collars mounted on the supportive pole, wherein the first sliding collar is located near the handle, wherein the third sliding collar is located near the cap, and wherein the second sliding collar is located between the first and third sliding collars; a canopy attached to a plurality of canopy support rods, wherein each of the plurality of canopy support rods is hingeably attached at one end to the third sliding collar; a first plurality of connector rods, wherein one end of each connector rod is hingeably attached to one of the canopy support rods and wherein the other end of the connector rod is hingeably attached to the second sliding collar; and a second plurality of connector rods, wherein one end of each connector rod is hingeably attached to one of the first plurality of connector rods and wherein the other end is hingeably attached to the first sliding collar.

In yet another aspect of this invention, an invertible umbrella is provided. An exemplary embodiment of this device includes: a supportive pole and a canopy assembly slidably mounted on the supportive pole. The supportive pole further comprises: a cap mounted on one end thereof; a handle mounted on the opposite end thereof; and first, second, and third locking members mounted partially within the supportive pole, wherein the first locking member is located near the handle, wherein the third locking member is located near the cap, and wherein the second locking member is located between the first and third locking members. The canopy assembly further comprises: first, second, and third sliding collars mounted on the supportive pole, wherein the first sliding collar is located nearest the handle, wherein the third sliding collar is located nearest the cap, and wherein the second sliding collar is located between the first and third sliding collars; a canopy attached to a plurality of canopy support rods, wherein each of the plurality of canopy support rods is hingeably attached at one end to the third sliding collar; a first plurality of connector rods, wherein one end of each connector rod is hingeably attached to one of the canopy support rods and wherein the other end of the connector rod is hingeably attached to the second sliding collar; and a second plurality of connector rods, wherein one end of each connector rod is hingeably attached to one of the first plurality of connector rods and wherein the other end is hingeably attached to the first sliding collar; and a pliable cup mounted on the first sliding collar for facilitating closure of the umbrella in an inverted orientation; and a slidable sleeve mounted on the supportive pole between the second and third sliding collars for facilitating closure of the umbrella in an inverted orientation.

The present invention is referred to as the "Inbrella" and provides an improved design for both the compact and large versions of the common umbrella. Advantageously, each of the exemplary embodiments of this umbrella folds inward so that the part of the umbrella that typically gets wet when in use folds in upon itself to prevent the user from getting wet when the umbrella is closed. Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
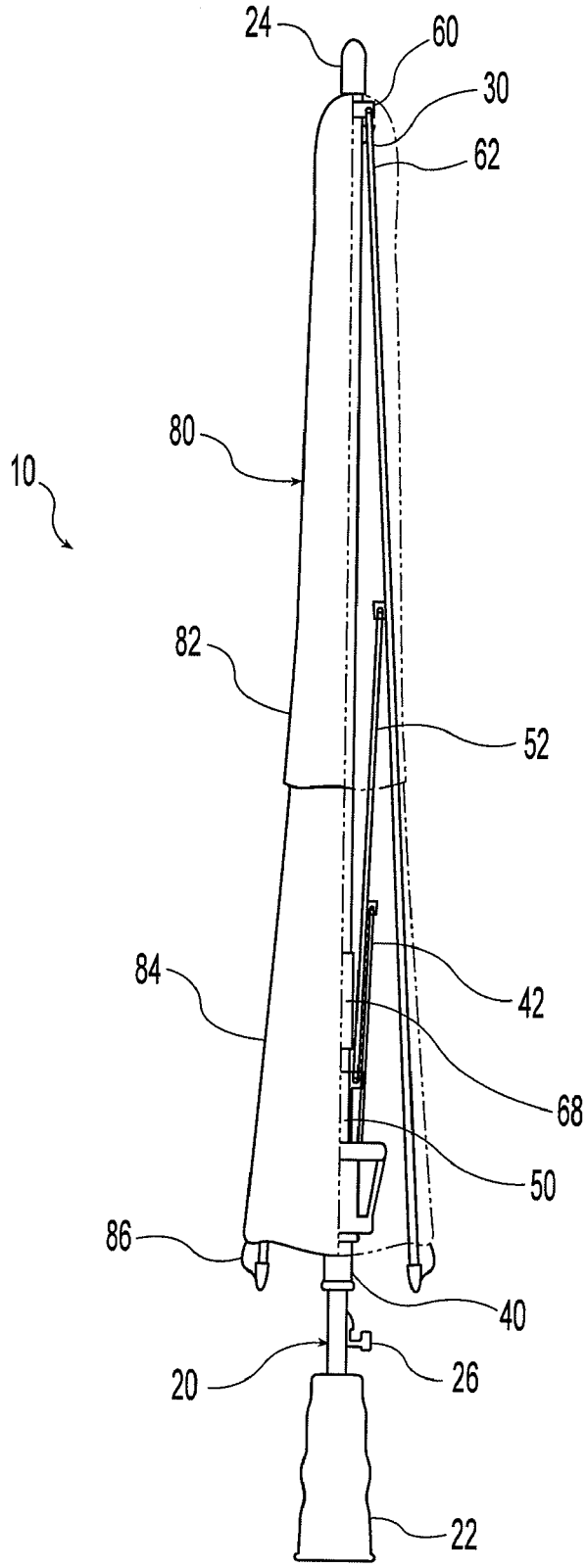
FIG. 1 is a side view of an exemplary embodiment of the reversible umbrella of the present invention shown in a normal, closed orientation.

Exemplary embodiments of the present invention are now described with reference to the Figures. Reference numerals are used throughout the detailed description to refer to the various elements and structures. In other instances, well-known structures and devices are shown in block diagram form for purposes of simplifying the description. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

The present invention relates to a mechanical device for protecting a person from the elements, including rain, sleet, and snow. As previously indicated, a first general embodiment of this invention provides a reversible umbrella; a second general embodiment of this invention provides an inwardly folding umbrella; and a third general embodiment of this invention provides an invertible umbrella. With reference now to the Figures, one or more specific embodiments of this invention shall be described in greater detail.

FIGS. 1-4 provide various views of an exemplary embodiment of the present invention in four different user-determined positions, namely closed in a "normal" position, open in a "normal" position, partially open in an inversed/reversed orientation, and closed in an inversed/reversed orientation. In this embodiment, reversible umbrella 10, which is also referred to herein as "inwardly closing" or "invertible", includes a centrally placed supportive pole 10 upon which a canopy assembly 35 is slidably mounted. Supportive pole 10 is at least partially hollow and is typically manufactured from metal; but as will be appreciated by the skilled artisan, this component may be manufactured from any suitably rigid and durable material. Supportive pole 20 also includes a plastic or rubber handle 22 attached to the bottom end thereof and a plastic or hard rubber cap 24 attached to the top end thereof. In the embodiment shown in the FIGS, three spring-loaded or otherwise biased locking members are installed, i.e., mounted, partially within pole 20. A portion of each locking member is disposed within pole 20 and a portion of each locking member protrudes therefrom. First locking member 26, which may include a button designed to receive a user's thumb, is mounted near handle 22; third locking member 30 is mounted near cap 24; and second locking member 28 is mounted between first and third locking members 26 and 30 respectively.

Figure 2:
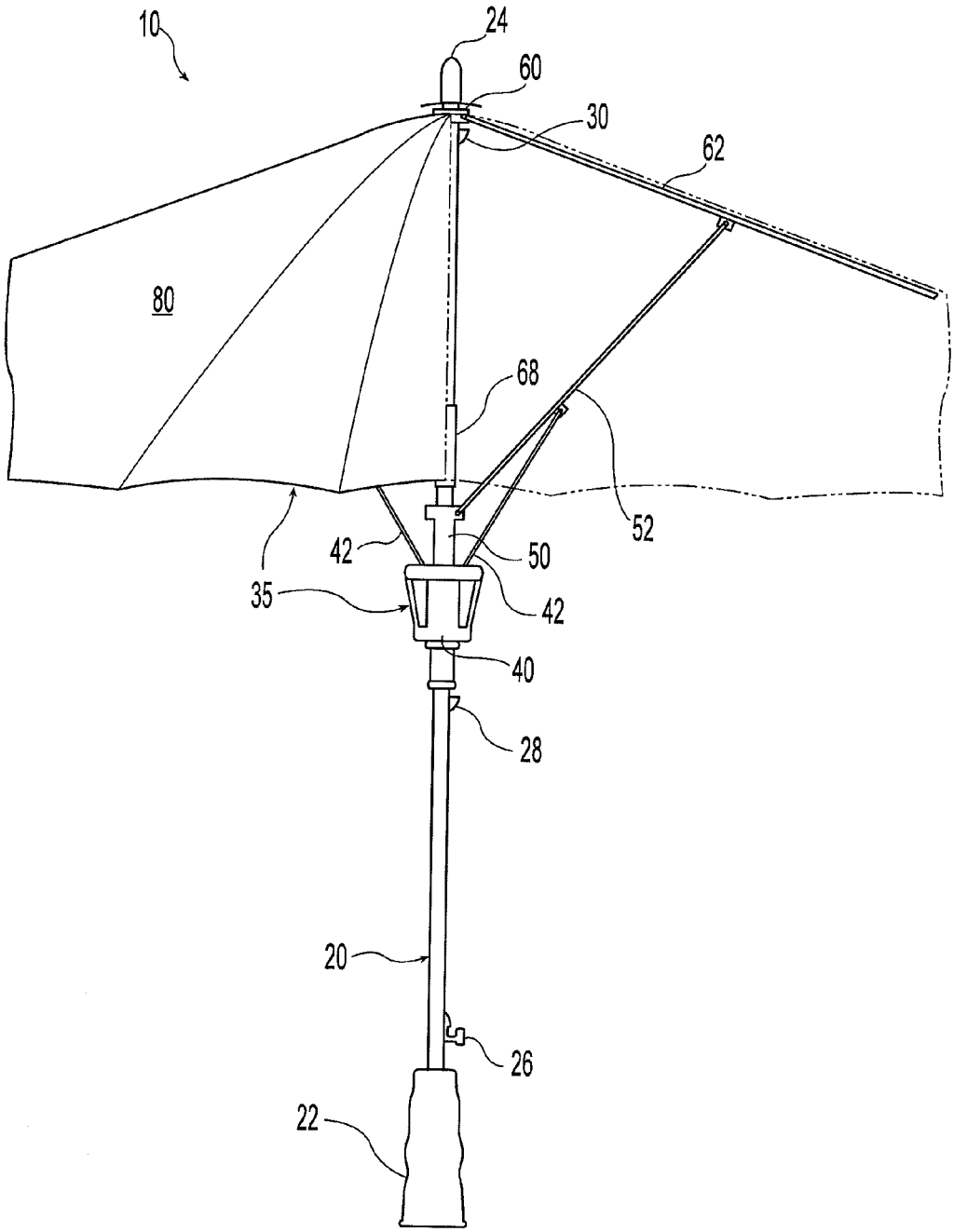
FIG. 2 is a side view of an exemplary embodiment of the reversible umbrella of the present invention shown in a normal, open position.
Figure 3:
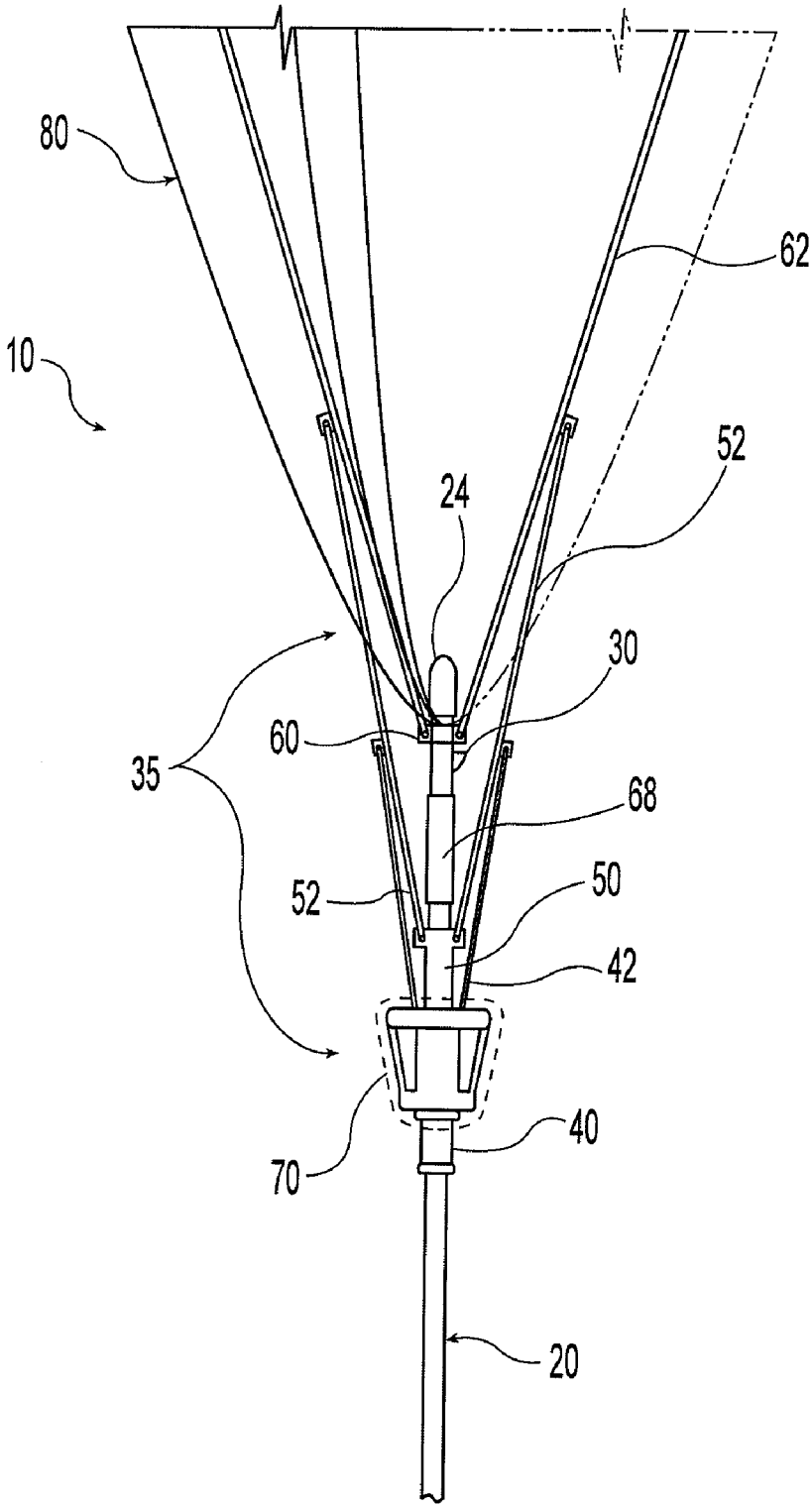
FIG. 3 is a side view of an exemplary embodiment of the reversible umbrella of the present invention shown partially open in an inversed/reversed orientation.

In the exemplary embodiment, the components of canopy assembly 35 move up or down supportive pole 20 in response to various manual actions taken by a user of invertible umbrella 10. Canopy assembly 35 includes canopy 80, plurality of canopy support rods 62, three sliding collars 40, 50, and 60, and first and second pluralities of connector rods 42 and 52. Canopy 80 includes a quantity of rain-repelling and/or water-resistant material and may include an upper canopy section 82, lower canopy section 84, and elastic straps 86 extending from lower canopy portion 84 to the terminus of each canopy support rod 62, all of which confer flexibility to canopy 80. Canopy 80 may also include a detached piece of canopy material circumferentially mounted on supportive pole 20 between the cap and the third sliding collar for preventing water from entering the interior of the umbrella around pole 20. First or "bottom" sliding collar 40 is located nearest the handle, third or "top" sliding collar 60 is located near cap 24 and second or "middle" sliding collar 50 is located between the first and third sliding collars. As best shown in FIGS. 2-3, each of the plurality of canopy support rods 62 is hingeably attached at one end to third sliding collar 60. A connector rod 52 is hingeably attached at one end to each canopy support rod 62 and to second sliding collar 50 at the other end. Another connector rod 42 is hingeably attached at one end to each connector rod 52 and to first sliding collar 40 at the other end. In the exemplary embodiment shown in the Figures, sliding sleeve 68 is also mounted on supportive pole 20 (see FIGS. 3-4) and cup 70 is mounted on first sliding collar 40.

Reversible umbrella 10 has two essentially "closed" positions. FIG. 1 shows the umbrella in a "normal" closed position and FIG. 2 shows the umbrella in an "inverted" closed position. FIG. 2 shows umbrella 10 in the normal open position, and FIG. 3 shows umbrella 10 partially closed in the inverted position. In use, umbrella 10 begins in the closed position shown in FIG. 1, with the top surface of canopy 80 facing upward and outward. The user pushes upward on first/bottom sliding collar 40 until first/bottom sliding collar 40 engages second/middle locking member 28. First/bottom sliding collar 40, second/middle sliding collar 50, and third/top sliding collar 60, all move upward on supportive pole 20 simultaneously. The upward motion of third/top sliding collar 60 is stopped by cap 24. Connector rods 42 push upward and outward on connector rods 52, and connector rods 52 push canopy support rods 62 upward and outward, thereby opening canopy 80. First/bottom sliding collar 40 engages second/middle locking member 28 to secure umbrella 10 in an open position. Reversible umbrella 10 is now in an open position with the top surface of the canopy facing outward (see FIG. 2).

The user then releases second/middle locking member 28 and pushes upward on first/bottom sliding collar 40. Third/top sliding collar 60 is held immobile against cap 24. First/bottom and second/middle sliding collars 40 and 50 move upward on supportive pole 20. Connector rods 42 push upward and outward on connector rods 52, and connector rods 52 push canopy support rods 62 upward and outward until the orientation of the canopy is reversed, i.e., the outer surface of canopy 80 is now on the "inside" of the device (see FIG. 3). During this motion, sliding sleeve 68 is pushed upward by second/middle sliding collar 50 until sliding sleeve 68 partially depresses third/top locking member 30 for preventing third/top locking member 30 from fully engaging third/top sliding collar 60. Pushing slightly upward on sliding cup 70 causes canopy 80 to more completely close/collapse upon itself in the reverse orientation.

Figure 4:
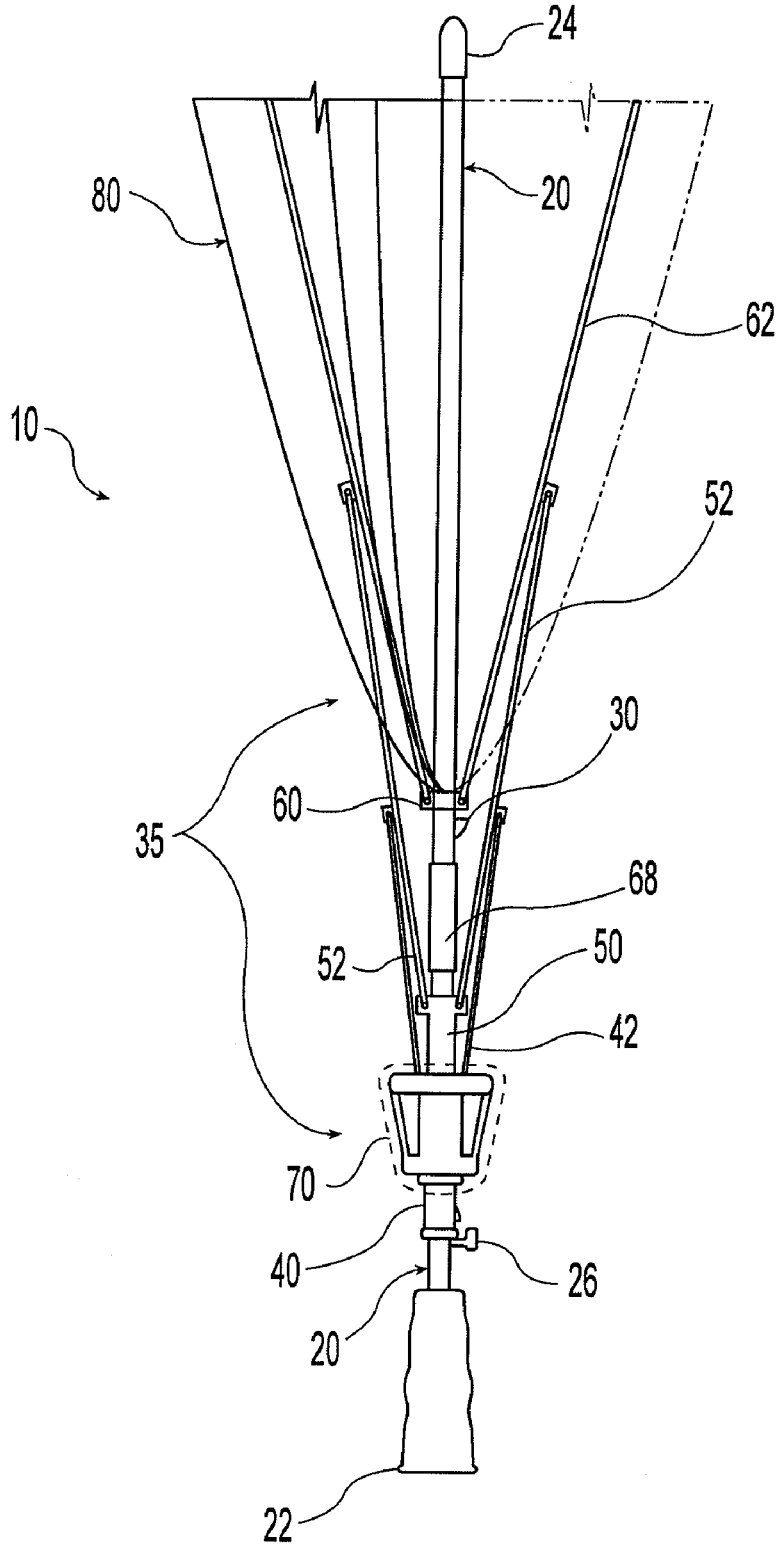
FIG. 4 is a side view of an exemplary embodiment of the reversible umbrella of the present invention shown closed in an inversed/reversed orientation.

With one hand, the user simultaneously grasps first/bottom sliding collar 40 and sliding cup 70, which assists in keeping canopy 80 closed in the reverse orientation, and slides the entire canopy assembly down supportive pole 20, until first/bottom sliding collar 40 engages first/bottom locking member 26 (see FIG. 4). It may be necessary for the user to release second/middle locking member 28 (midway along the length of supportive pole 20) if first/bottom sliding collar 40 inadvertently engages second/middle locking member 28 during the downward motion of canopy assembly 35. Inadvertent engagement of these components may be prevented by the user depressing second/middle locking member 28 with the thumb of their other hand while guiding canopy assembly 35 downward on supportive pole 20. When umbrella 10 is closed in this manner, i.e., in the reverse orientation, the umbrella may be stood upside down on the ends of canopy support rods 62 for allowing water to drain off of canopy 80 and out of umbrella 10.

To return umbrella 10 to the open position, the user releases first/bottom locking member 26 with one hand, and then with the other hand grasps first/bottom sliding collar 40 and sliding cup 70 and pushes upward on canopy assembly 35. Canopy assembly 35 travels upward along the length of supportive pole 20 until third/top sliding collar 60 contacts and is stopped by cap 24. In the exemplary embodiment, the user also releases second/middle locking member 28 because first/bottom sliding collar 40 will naturally engage second/middle locking member 28 as canopy assembly 35 travels upward on supportive pole 20 toward cap 24.

With canopy assembly 35 still in the inverted position at the top end of supportive pole 20, the user pulls slightly downward on canopy assembly 35 such that sleeve 68 disengages third/top locking member 30 and third/top sliding collar 60 then engages third/top locking member 30. With third/top sliding collar 60 seated against or within third/top locking member 30, the user then pulls downward on first/bottom sliding collar 40 until first/bottom sliding collar 40 engages second/middle locking member 28. Pulling downward on first/bottom sliding collar 40 causes connector rods 42 to exert downward force on connector rods 52, which in turn exert downward force on canopy support rods 62 and cause canopy 80 to revert back to its normal orientation (i.e., the outer surface of the canopy facing outward). The user then closes umbrella 10 by releasing second/middle locking member 28 and sliding first/bottom sliding collar 40 downward on supportive pole 20 until canopy 80 is closed as in FIG. 1.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A reversible umbrella, comprising:

(a) a supportive pole having an upper portion and a lower portion; wherein the supportive pole further comprises:
  (i) a cap mounted on one end thereof;
  (ii) a handle mounted on the opposite end thereof; and
  (iii) first, second, and third locking members mounted partially within the supportive pole, wherein the first locking member is located near the handle, wherein the third locking member is located near the cap, and wherein the second locking member is located between the first and third locking members; and (b) a canopy assembly slidably mounted on the supportive pole, wherein the canopy assembly further includes:
  (i) first, second, and third sliding collars mounted on the supportive pole, wherein the first sliding collar is located on the lower portion of the pole, wherein the third sliding collar is located on the upper portion of the pole, and wherein the second sliding collar is located between the first and third sliding collars;
  (ii) a canopy attached to a plurality of canopy support rods, wherein each of the plurality of canopy support rods is hingeably attached at one end to the third sliding collar;
  (iii) a first plurality of connector rods, wherein one end of each connector rod is hingeably attached to one of the canopy support rods and wherein the other end of the connector rod is hingeably attached to the second sliding collar; and
  (iv) a second plurality of connector rods, wherein one end of each connector rod is hingeably attached to one of the first plurality of connector rods and wherein the other end is hingeably attached to the first sliding collar; and (c) wherein the canopy support rods extend downward in an open orientation and extend upward in an inverted orientation, the third sliding collar being retained in a location near the cap by the third locking member while the first sliding collar cooperates with the second locking member to retain the umbrella in an open orientation, and wherein the first, second, and third sliding collars are pulled together downward to a location near the handle, and the first and second connector rods and the supportive rods turned upward respectively in an inverted orientation, and the first sliding collar also cooperates with the first locking member to retain the umbrella in a closed, inverted position.

2. The reversible umbrella of claim 1, further comprising a pliable cup mounted on the first sliding collar for facilitating closure of the umbrella in an inverted orientation.

3. The reversible umbrella of claim 1, further comprising a slidable sleeve mounted on the supportive pole between the second and third sliding collars for facilitating closure of the umbrella in an inverted orientation.

4. The reversible umbrella of claim 1, further comprising a plurality of elastic connectors, wherein one end of each elastic connector is attached to the canopy, and wherein the other end is attached to a canopy support rod opposite the end hingeably attached to the third sliding collar.

5. The reversible umbrella of claim 1, wherein the canopy further comprises an upper portion and a lower portion connected to the upper portion.

6. An inwardly folding umbrella, comprising:

(a) a supportive pole, wherein the supportive pole further includes:
  (i) a cap mounted on one end thereof;
  (ii) a handle mounted on the opposite end thereof; and (iii) first, second, and third locking members mounted partially within the supportive pole, wherein the first locking member is located near the handle, wherein the third locking member is located near the cap, and wherein the second locking member is located between the first and third locking members; and (b) a canopy assembly slidably mounted on the supportive pole, wherein the canopy assembly further includes:

(i) first, second, and third sliding collars mounted on the supportive pole, wherein the first sliding collar is located near the handle, wherein the third sliding collar is located near the cap, and wherein the second sliding collar is located between the first and third sliding collars;

(ii) a canopy attached to a plurality of canopy support rods, wherein each of the plurality of canopy support rods is hingeably attached at one end to the third sliding collar;

(iii) a first plurality of connector rods, wherein one end of each connector rod is hingeably attached to one of the canopy support rods and wherein the other end of the connector rod is hingeably attached to the second sliding collar; and (iv) a second plurality of connector rods, wherein one end of each connector rod is hingeably attached to one of the first plurality of connector rods and wherein the other end is hingeably attached to the first sliding collar; and (c) wherein the canopy support rods extend downward in an open orientation and extend upward in an inverted orientation, the third sliding collar being retained in a location near the cap by the third locking member while the first sliding collar cooperates with the second locking member to retain the umbrella in an open orientation, and wherein the first, second, and third sliding collars are pulled together downward to a location near the handle, and the first and second connector rods and the supportive rods turned upward respectively in an inverted orientation, and the first sliding collar also cooperates with the first locking member to retain the umbrella in a closed, inverted position.

7. The reversible umbrella of claim 6, further comprising a pliable cup mounted on the first sliding collar for facilitating closure of the umbrella in an inverted orientation.

8. The reversible umbrella of claim 6, further comprising a slidable sleeve mounted on the supportive pole between the second and third sliding collars for facilitating closure of the umbrella in an inverted orientation.

9. The reversible umbrella of claim 6, further comprising a plurality of elastic connectors, wherein one end of each elastic connector is attached to the canopy, and wherein the other end is attached to a canopy support rod opposite the end hingeably attached to the third sliding collar.

10. The reversible umbrella of claim 6, wherein the canopy further comprises an upper portion and a lower portion connected to the upper portion.

11. An invertible umbrella, comprising:

(a) a supportive pole, wherein the supportive pole further includes:

(i) a cap mounted on one end thereof;

(ii) a handle mounted on the opposite end thereof; and (iii) first, second, and third locking members mounted partially within the supportive pole, wherein the first locking member is located near the handle, wherein the third locking member is located near the cap, and wherein the second locking member is located between the first and third locking members; and (b) a canopy assembly slidably mounted on the supportive pole, wherein the canopy assembly further includes:

(i) first, second, and third sliding collars mounted on the supportive pole, wherein the first sliding collar is located nearest the handle, wherein the third sliding collar is located nearest the cap, and wherein the second sliding collar is located between the first and third sliding collars;

(ii) a canopy attached to a plurality of canopy support rods, wherein each of the plurality of canopy support rods is hingeably attached at one end to the third sliding collar;

(iii) a first plurality of connector rods, wherein one end of each connector rod is hingeably attached to one of the canopy support rods and wherein the other end of the connector rod is hingeably attached to the second sliding collar; and (iv) a second plurality of connector rods, wherein one end of each connector rod is hingeably attached to one of the first plurality of connector rods and wherein the other end is hingeably attached to the first sliding collar; and (c) a pliable cup mounted on the first sliding collar for facilitating closure of the umbrella in an inverted orientation;

(d) a slidable sleeve mounted on the supportive pole between the second and third sliding collars for facilitating closure of the umbrella in an inverted orientation; and (e) wherein the canopy support rods extend downward in an open orientation and extend upward in an inverted orientation, the third sliding collar being retained in a location near the cap by the third locking member while the first sliding collar cooperates with the second locking member to retain the umbrella in an open orientation, and wherein the first, second, and third sliding collars are pulled together downward to a location near the handle, and the first and second connector rods and the supportive rods turned upward respectively in an inverted orientation, and the first sliding collar also cooperates with the first locking member to retain the umbrella in a closed, inverted position.

12. The reversible umbrella of claim 11, further comprising a plurality of elastic connectors, wherein one end of each elastic connector is attached to the canopy, and wherein the other end is attached to a canopy support rod opposite the end hingeably attached to the third sliding collar.

13. The reversible umbrella of claim 11, wherein the canopy further comprises an upper portion and a lower portion connected to the upper portion.

14. The reversible umbrella of claim 11, wherein the canopy further includes a detached piece of canopy material circumferentially mounted on the supportive pole between the cap and the third sliding collar.

* * * * *